US012416108B2

(12) United States Patent
Lin

(10) Patent No.: US 12,416,108 B2
(45) Date of Patent: Sep. 16, 2025

(54) SAFETY STRAP

(71) Applicant: Chung-Kun Lin, Chiayi (TW)

(72) Inventor: Chung-Kun Lin, Chiayi (TW)

( * ) Notice: Subject to any disclaimer, the term of this patent is extended or adjusted under 35 U.S.C. 154(b) by 15 days.

(21) Appl. No.: 18/102,562

(22) Filed: Jan. 27, 2023

(65) Prior Publication Data

US 2024/0254663 A1 Aug. 1, 2024

(51) Int. Cl.

| | |
|---|---|
| ***D03D 11/00*** | (2006.01) |
| ***D03D 1/00*** | (2006.01) |
| ***D03D 15/63*** | (2021.01) |
| *D03D 13/00* | (2006.01) |

(52) U.S. Cl.
CPC ..... *D03D 15/63* (2021.01); *D03D 1/0005* (2013.01); *D10B 2403/023* (2013.01)

(58) Field of Classification Search
CPC . D03D 15/63; D03D 1/0005; D10B 2403/023
See application file for complete search history.

(56) References Cited

U.S. PATENT DOCUMENTS 4,004,616 A * 1/1977 Andronov ..... D03D 1/0005 139/426 R
5,202,070 A * 4/1993 Schneider ..... B29C 70/30 264/137
5,592,977 A * 1/1997 Kikuchi ..... D03D 35/00 428/36.1

FOREIGN PATENT DOCUMENTS

EP 0632152 B1 * 9/2000 ..... D03D 1/00
WO WO-9406373 A1 * 3/1994 ..... A61F 2/06

* cited by examiner

*Primary Examiner* — Robert H Muromoto, Jr.

(57) ABSTRACT

A safety strap has an outer layer, an inner layer disposed in the outer layer and a plurality of interlace strands. The inner layer has a plurality of warp strand bundles and a plurality of first weft strands woven with each other. Each of the warp strand bundles has more than one first warp strand. The outer layer is woven with a plurality of second warp strands and a plurality of second weft strands. The interlace strands continuously intertwine with the second weft strands and the first weft strands.

3 Claims, 9 Drawing Sheets

SAFETY STRAP

BACKGROUND OF INVENTION

Field of Invention

The present invention relates to a safety strap.

Description of the Related Art

When working at high locations, personnel are required to wear anti-fall clothing or anti-fall belts on their bodies, so that they can be connected with anti-fall devices through the safety strap to protect personnel from working or moving at heights.

The conventional safety strap, as shown in FIG. 8, the safety strap 40 includes the outer layer 42, and the inner layer 41 wrapped in the outer layer 42. The inner layer 41 is made of many warp strands 411, and the outer layer 42 is made of many warp strands 421 and many weft strands 422. The inner layer 41 is directly covered by the outer layer 42 to form a the safety strap structure.

However, the above conventional structure still has the following problem: the outer layer 42 only wraps the inner layer 41 inside, and not producing a reinforce effect on the inner layer 41. Therefore, when the outer layer 42 is damaged due to the friction of use, such as being worn out by the sharp edge of a high-rise building, it can cause the warp strands 411 of the inner layer 41 to spread out from the damaged opening, allowing the safety strap 40 easy to break due to the loosen warp strands 411, as shown in FIG. 9.

Therefore, it is desirable to provide a safety strap to mitigate and/or obviate the aforementioned problems.

SUMMARY OF THE INVENTION

An objective of present invention is to provide a safety strap which is capable of improving the above-mention problems.

In order to achieve the above mentioned objective, a safety strap has an outer layer, an inner layer disposed in the outer layer and a plurality of interlace strands. The inner layer has a plurality of warp strand bundles and a plurality of first weft strands woven with each other. Each of the warp strand bundles has more than one first warp strand. The outer layer is woven with a plurality of second warp strands and a plurality of second weft strands. The interlace strands continuously intertwine with the second weft strands and the first weft strands.

Other objects, advantages, and novel features of invention will become more apparent from the following detailed description when taken in conjunction with the accompanying drawings.

DETAILED DESCRIPTION OF THE PREFERRED EMBODIMENT

Figure 1:
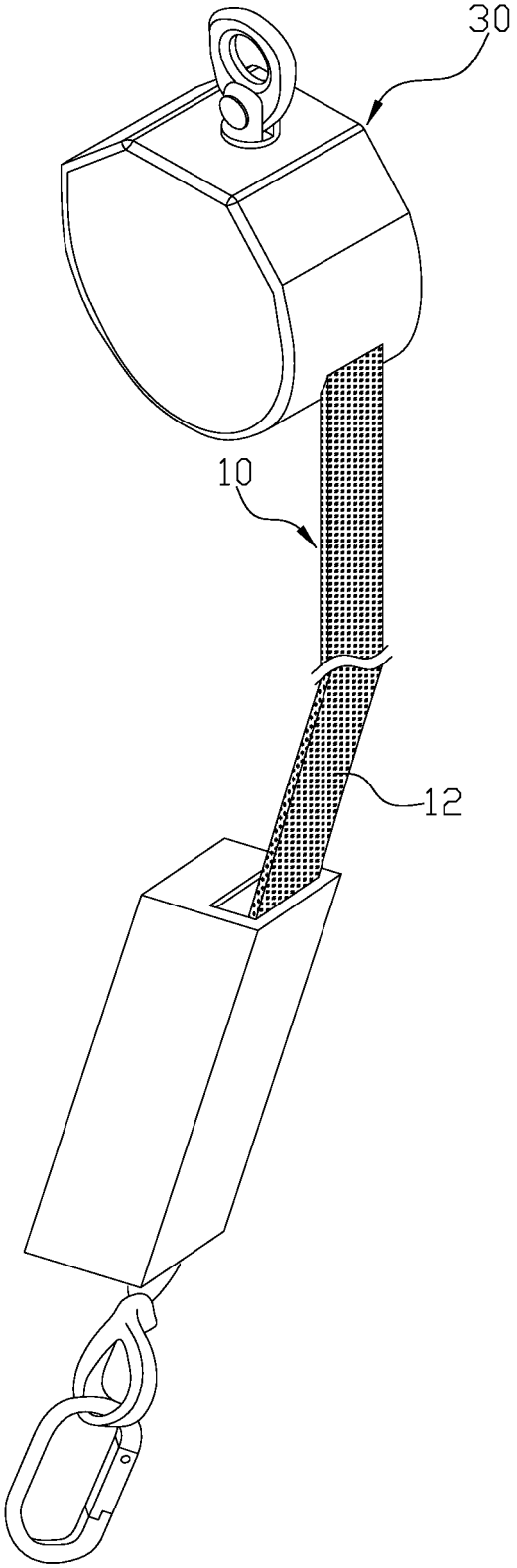
FIG. 1 is a three-dimensional view of the connection between the present invention and a fall arrester.
Figure 2:
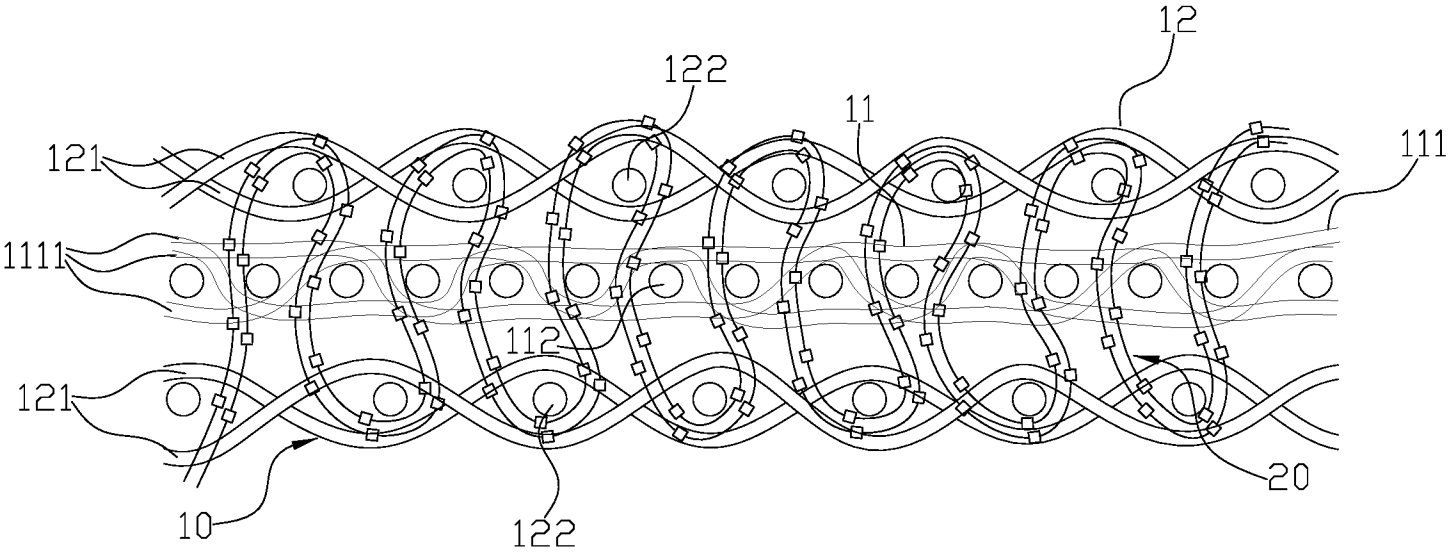
FIG. 2 is the winding drawing of an embodiment of the present invention.
Figure 3:
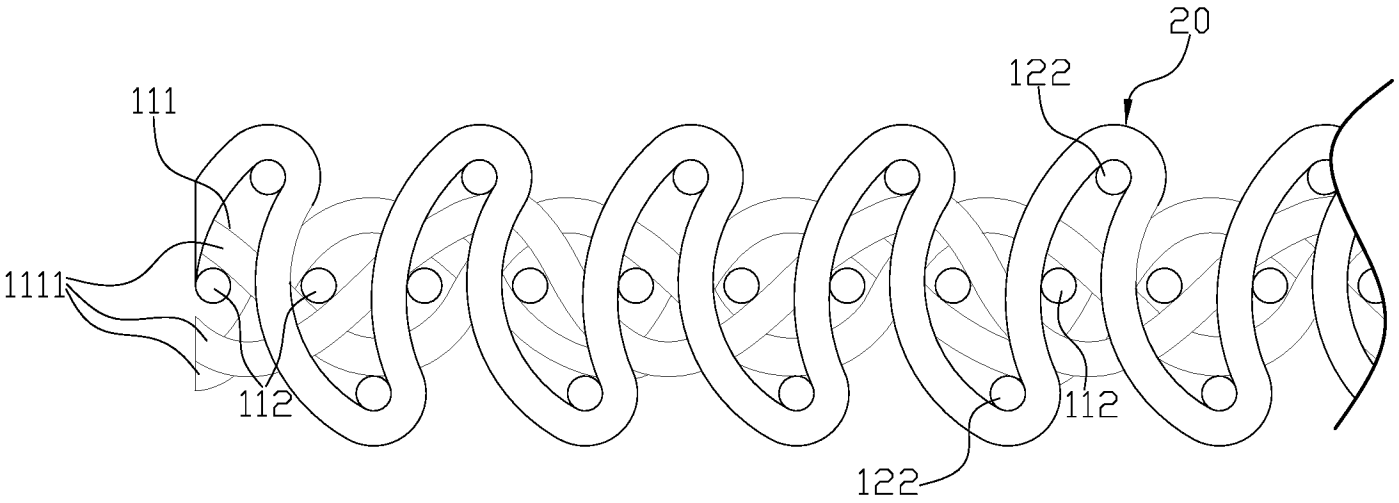
FIG. 3 is an enlarged view of the winding of the present invention.
Figure 4:
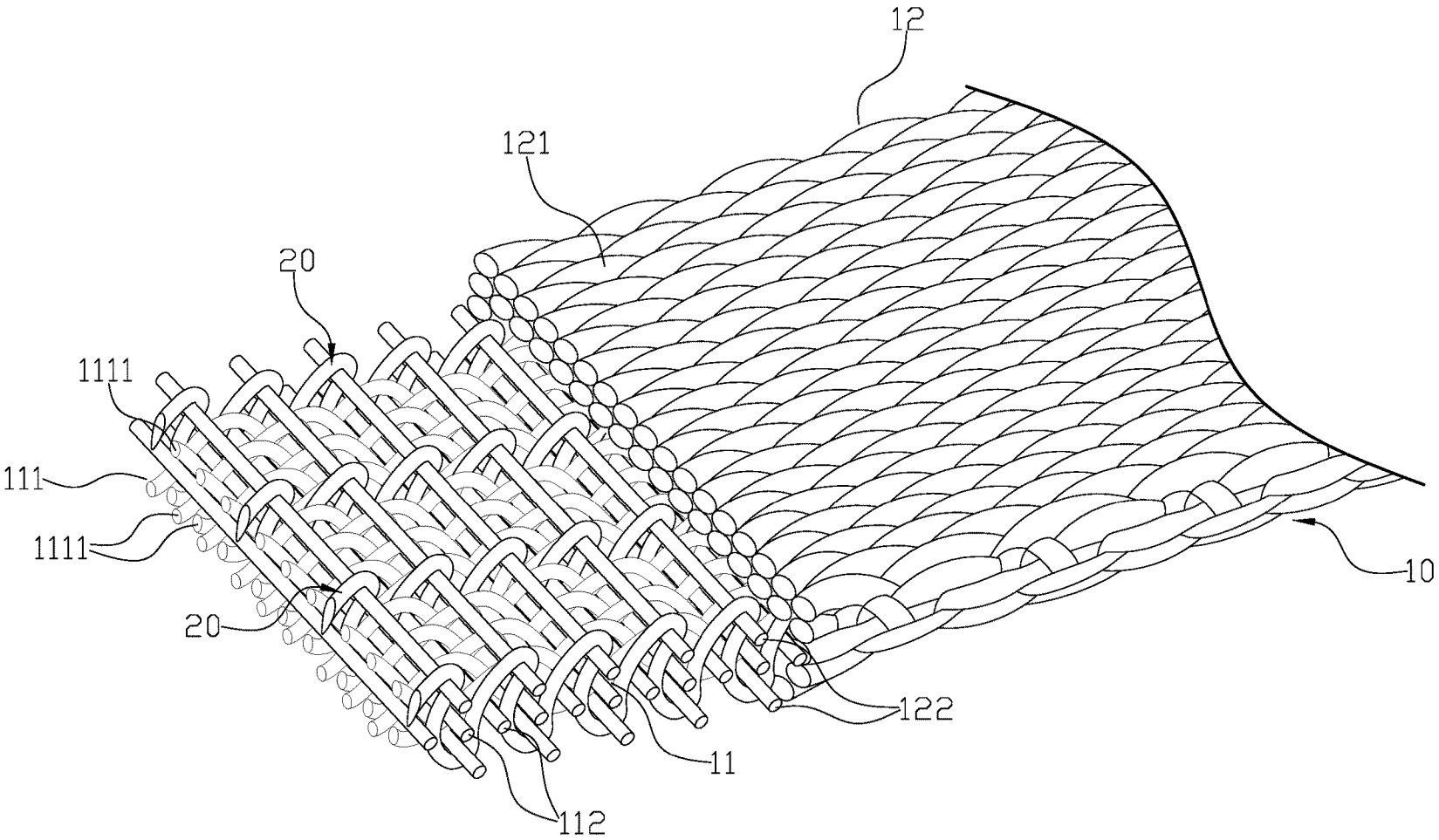
FIG. 4 is a cross-sectional view of the present invention.

First, please refer to FIG. 1-FIG. 4. A safety strap 10 comprises an outer layer 12 an inner layer 11 disposed in the outer layer 12 and a plurality of interlace strands 20. The inner layer 11 has a plurality of warp strand bundles 111 and a plurality of first weft strands 112 woven with each other. Each of the warp strand bundle 111 has more than one first warp strand 1111. The outer layer 12 is woven with a plurality of second warp strands 121 and a plurality of second weft strands 122. The interlace strands 20 continuously intertwine with the second weft strands 122 and the first weft strands 112. With the interlace strands 20, the inner layer 11 and the outer layer 12 are combined together and a reinforcement effect is provided to the inner layer 11.

Furthermore, the warp strand bundle 111 are woven with three first warp strands 1111.

Moreover, the warp strand bundles 111 are woven with three first warp strands 1111, two of the three first warp strands 1111 respectively pass several first weft strands 112 from above and from below, and another first warp strand 1111 continuously passes around the first weft strand 112.

Furthermore, the first warp strand 1111, the second warp strand 121, the first weft strand 112 and the second weft strand 122 are multifilament polymer strands, which are composed of UV-resistant liquid crystal aromatic polyester fibers, also known as LCP liquid crystal polymer aromatic polyester fiber.

In addition, the outer layer 12 is completely wrapped around the inner layer 11.

Figure 5:
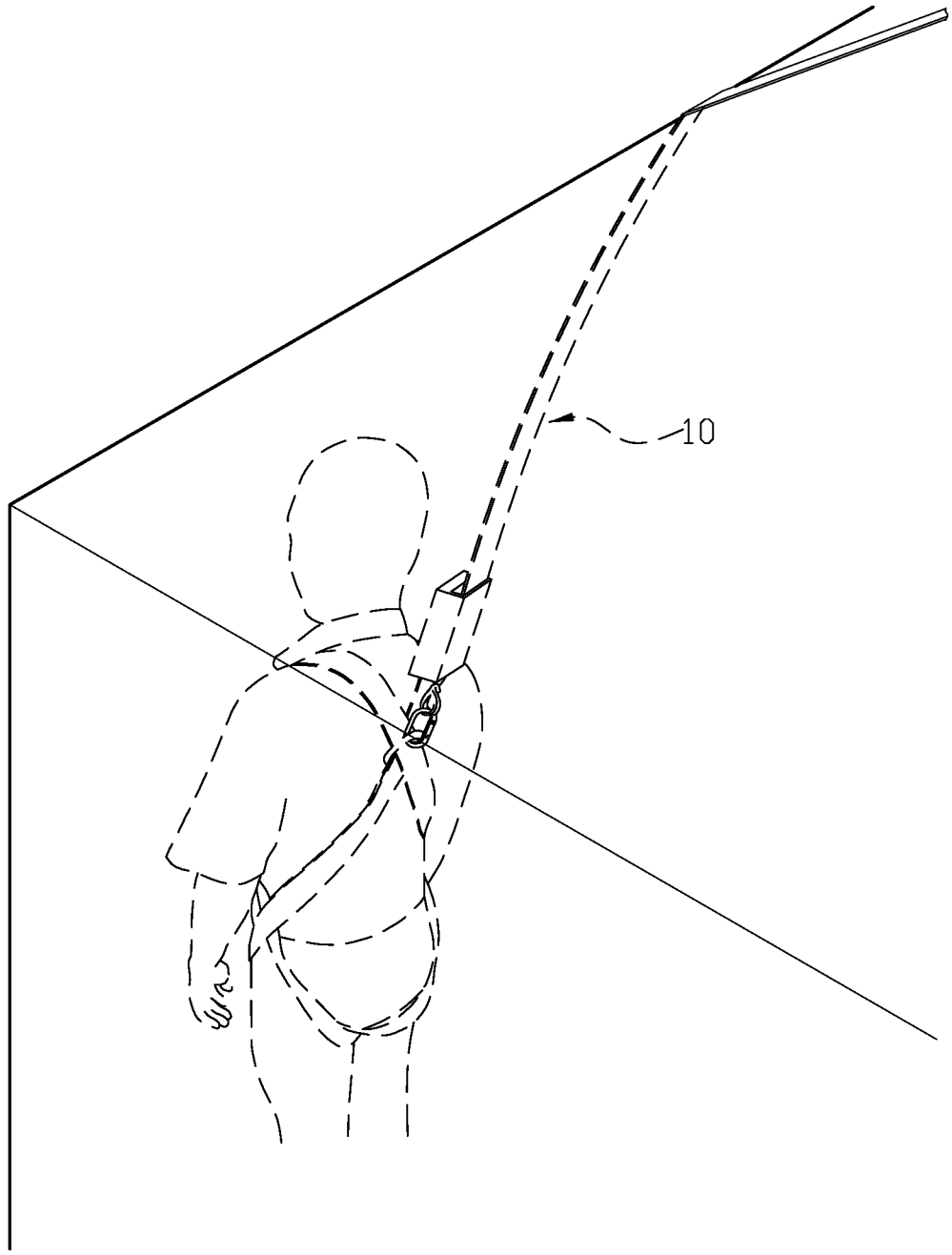
FIG. 5 is the state drawing showing the present invention accidentally dropping and rubbing against the building when it is in use.
Figure 6:
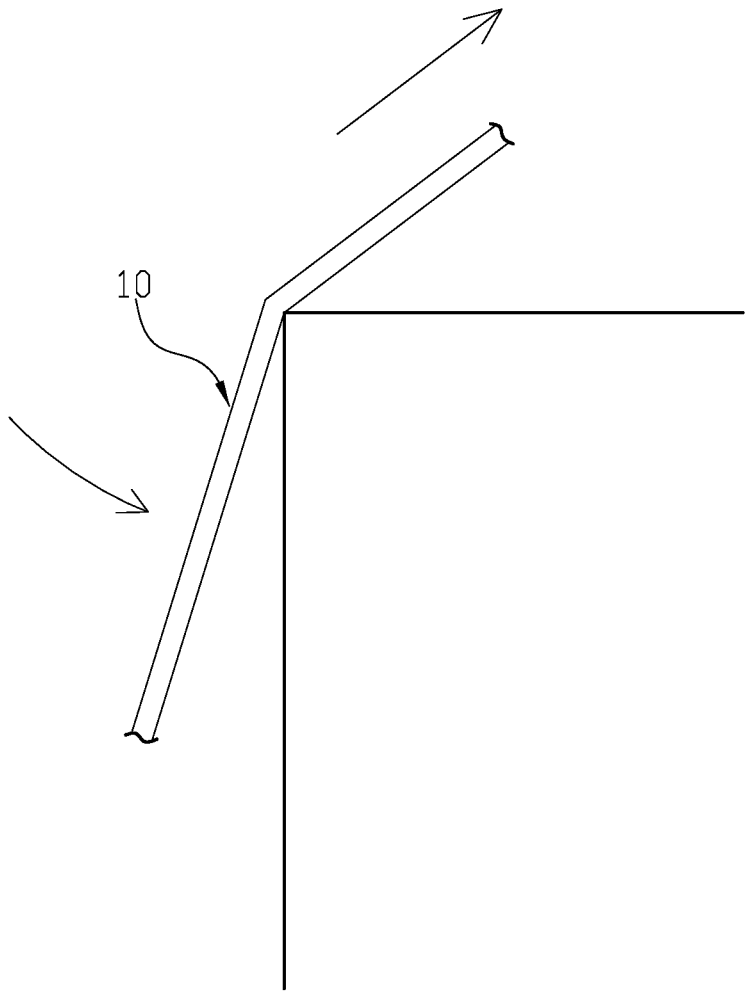
FIG. 6 is a schematic drawing showing the friction occurring in the present invention.
Figure 7:
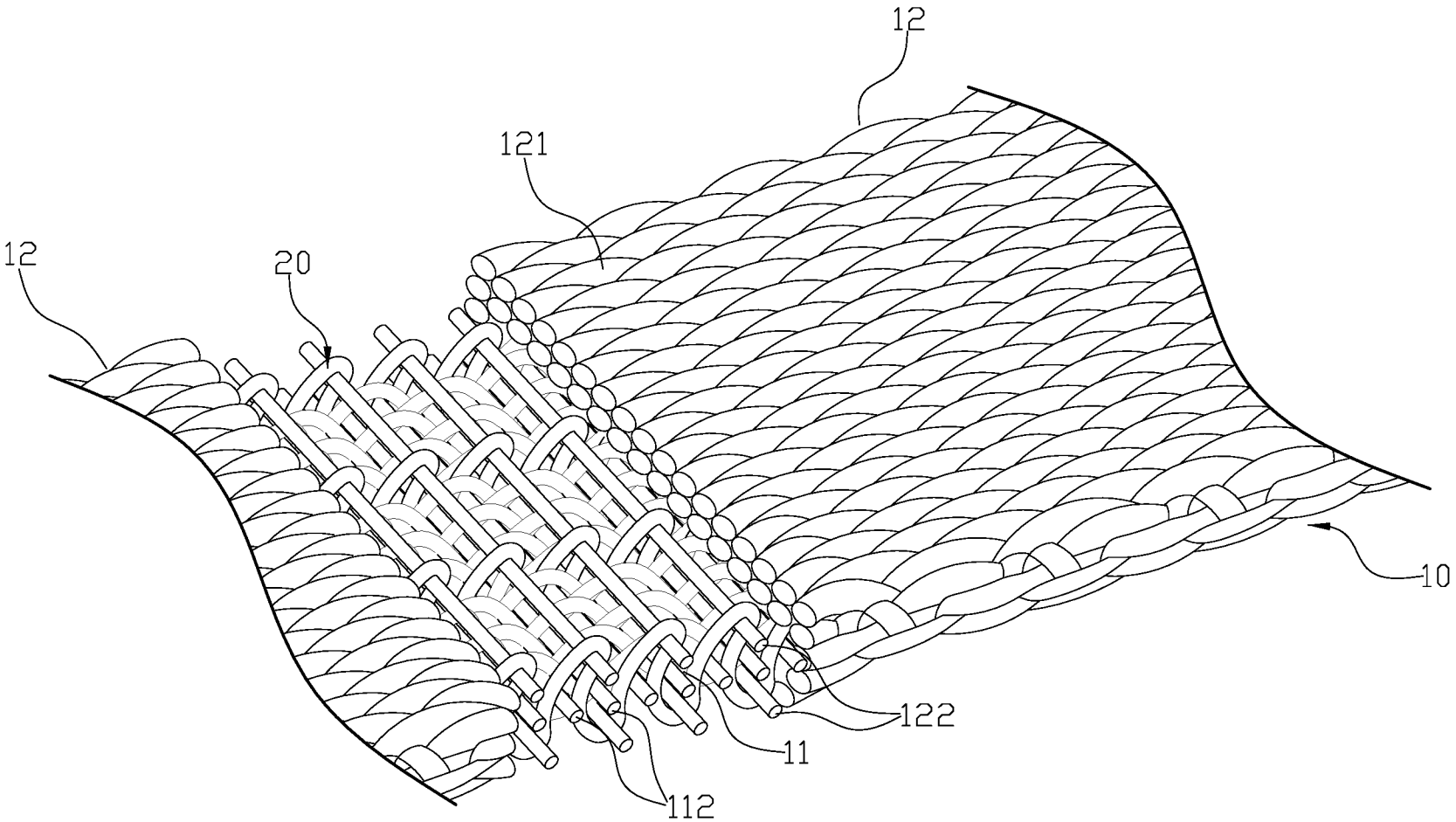
FIG. 7 is a state drawing of the present invention that does not break after being rubbed.
Figure 8:
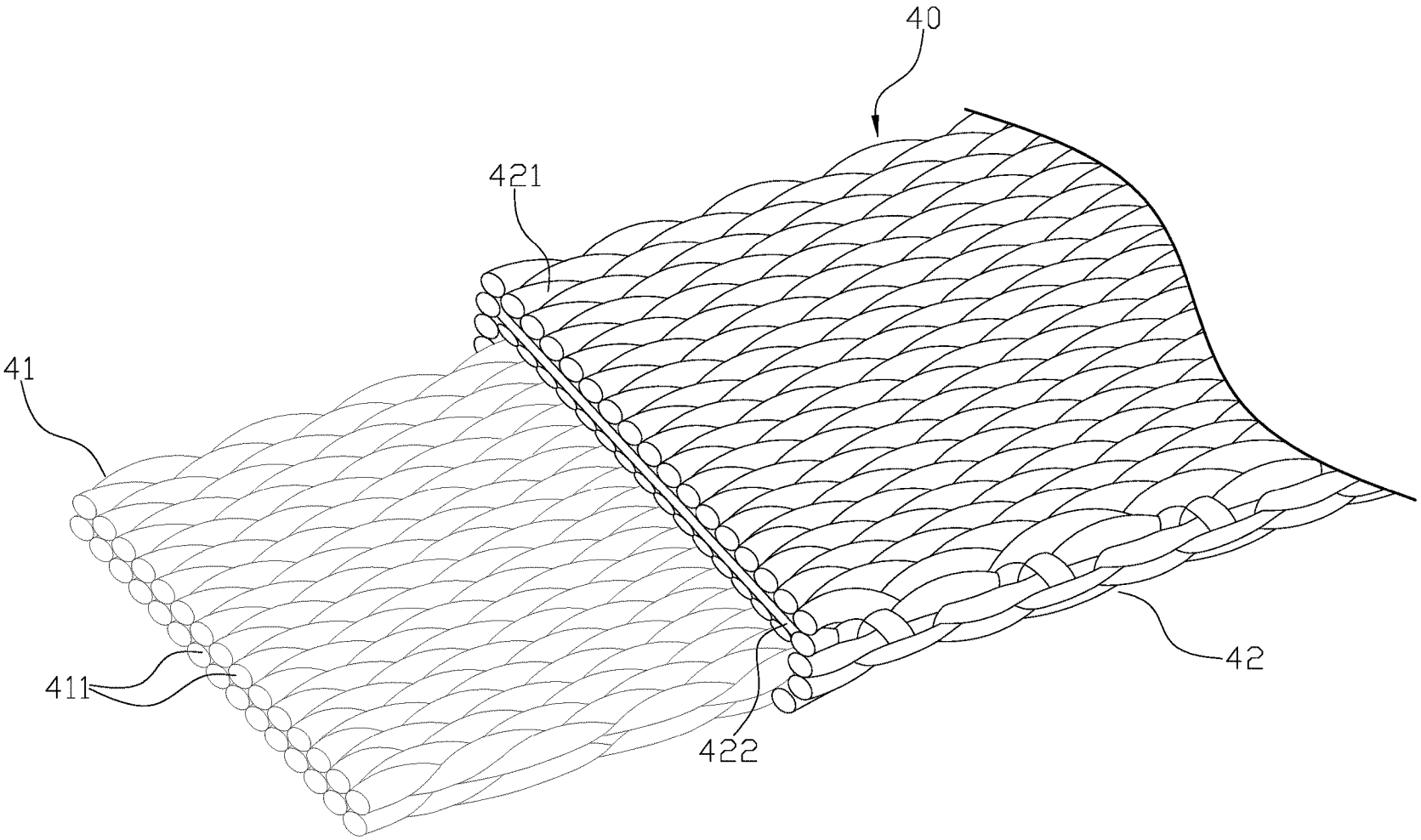
FIG. 8 PRIOR ART
FIG. 8 is a structural diagram of a prior art.
Figure 9:
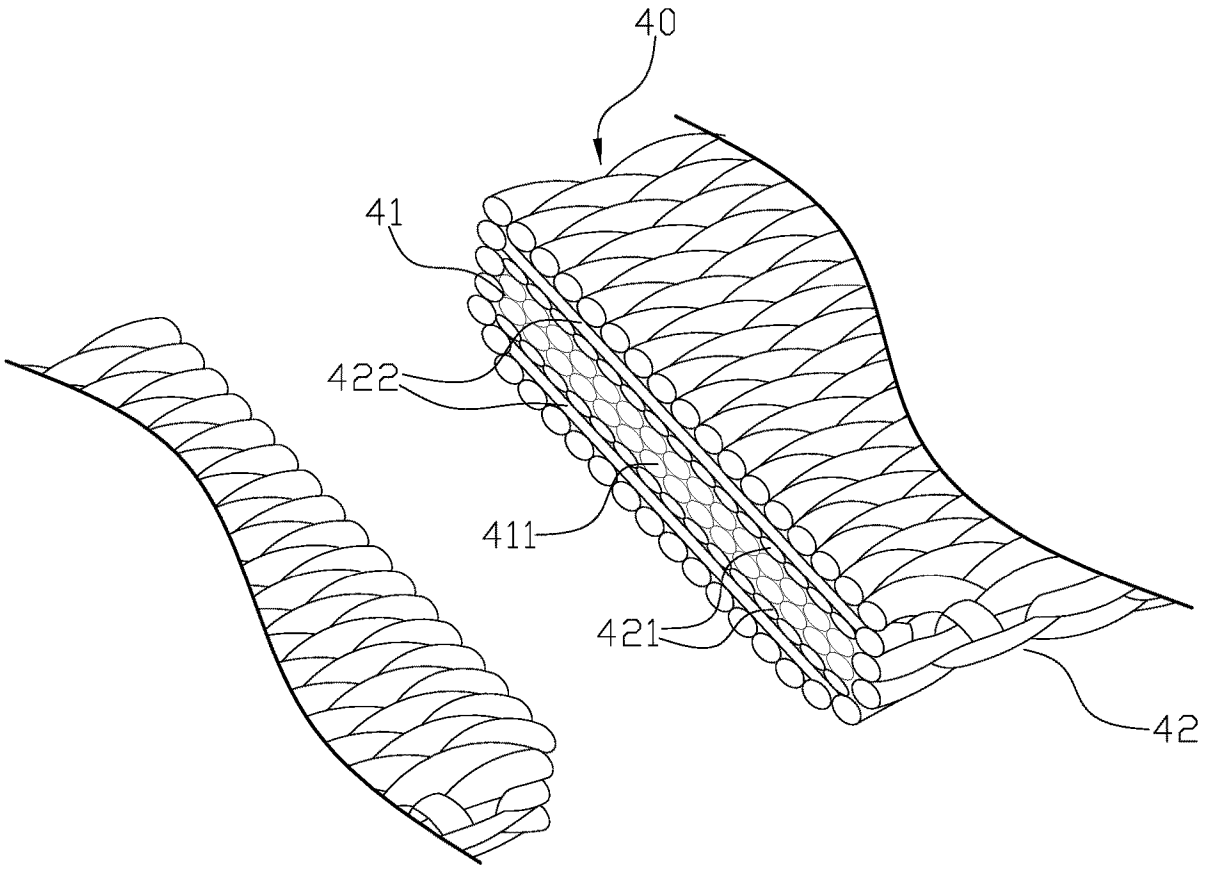
FIG. 9 PRIOR ART
FIG. 9 is a diagram showing the fractured state after conventional friction.

For actual operation, the safety strap 10 is equipped with the anti-fall clothing or the anti-fall belt on a user's body, so that the anti-fall clothing or the anti-fall belt can be connected with the anti-fall device 30 via the safety strap 10, as shown in FIG. 1, to ensure the safety of personnel working at heights or activities. If the user accidentally falls during the operation or the second warp strand 121 of the outer layer 12 is worn out and damaged due to friction from the wall, the support or the iron sheet of the building, as shown in FIG. 5 and FIG. 6, the warp strand bundle 111 can still be tightened continuously through the interlace strands 20, and the first warp strands 1111 of the warp strand bundle 111 are not spread out at the damaged opening, therefore, the safety strap 10 can be kept in a tightened and not loose state because the warp strand bundle 111 is still in a tightened and not loose state and will not break, as shown in FIG. 7. Also, the safety strap 10 has the tightening and strengthening effect of the inner layer 11, so its structural strength can be significantly improved.

Although the present invention has been explained in relation to its preferred embodiment, it is to be understood that many other possible modifications and variations can be made without departing from the spirit and scope of invention as hereinafter claimed.

What is claimed is:

1. A safety strap comprising:

a top layer, a bottom laver, a middle layer disposed between the top layer and the bottom layer, and a plurality of interlace strands;

wherein:

the middle layer comprises a plurality of warp strand bundles and a plurality of first weft strands woven with each other, each of the warp strand bundles comprising more than one first warp strand, each first warp strand consecutively float woven with groups of three first weft strands;

the top layer and the bottom layer are respectively woven with a plurality of second warp strands and a plurality of second weft strands; and the interlace strands continuously intertwine with the second weft strands of the top layer, the second weft strands of the bottom layer, and the first weft strands;

wherein each interlace strand immediately and consecutively sandwiches each of the second weft strands of the top layer, each of the first weft strands, and each of the second weft strands of the bottom layer.

2. The safety strap as claimed in claim 1, wherein the warp strand bundles are woven with three first warp strands.

3. The safety strap as claimed in claim 1, wherein each of the warp strand bundles comprises three first warp strands, two of the three first warp strands respectively pass several first weft strands from above and from below, and another first warp strand sequentially passes above and below the first weft strand.

* * * * *